US011123257B2

(12) United States Patent
Crocco

(10) Patent No.: US 11,123,257 B2
(45) Date of Patent: Sep. 21, 2021

(54) FOAM GLIDE

(71) Applicant: Joseph Crocco, Castiac, CA (US)

(72) Inventor: Joseph Crocco, Castiac, CA (US)

( * ) Notice: Subject to any disclaimer, the term of this patent is extended or adjusted under 35 U.S.C. 154(b) by 185 days.

(21) Appl. No.: 16/546,126

(22) Filed: Aug. 20, 2019

(65) Prior Publication Data

US 2021/0052462 A1 Feb. 25, 2021

(51) Int. Cl.

*A61H 15/00* (2006.01)
*A63B 21/00* (2006.01)
*A63B 22/20* (2006.01)

(52) U.S. Cl.

CPC ..... *A61H 15/00* (2013.01); *A63B 21/4033* (2015.10); *A63B 21/4035* (2015.10); *A63B 22/203* (2013.01); *A61H 2015/0014* (2013.01); *A61H 2201/1261* (2013.01); *A61H 2201/169* (2013.01); *A63B 2208/0252* (2013.01)

(58) Field of Classification Search

CPC ..... A61H 15/00; A61H 2015/0014; A61H 2201/1261; A61H 2201/169; A61H 1/00; A61H 2201/164; A61H 2201/5002; A61H 2201/0134; A61H 2201/0157; A61H 2205/12; A61H 2205/125; A61B 21/4033; A61B 22/203; A61B 21/4035; A61B 2208/0252

See application file for complete search history.

(56) References Cited

U.S. PATENT DOCUMENTS 2,693,796 A * 11/1954 Warner ..... A61H 1/0222 601/98
3,088,458 A * 5/1963 Stewart ..... A61H 15/00 601/122
3,523,524 A * 8/1970 Wilson ..... A61H 15/0078 601/115
3,620,530 A * 11/1971 Cosby ..... A63B 21/0552 482/130
4,004,801 A * 1/1977 Campanaro ..... A61H 1/0218 482/96
4,192,296 A * 3/1980 St. Mary ..... A61H 1/00 601/102
4,218,093 A * 8/1980 Gertz ..... A47C 16/025 297/270.3
4,354,485 A * 10/1982 Safadago ..... A61G 13/009 606/242
4,790,529 A * 12/1988 Pelle ..... A63B 21/0628 248/166
5,505,691 A * 4/1996 Fenkell ..... A61H 1/0222 601/116

(Continued)

*Primary Examiner* — Andrew S Lo
(74) *Attorney, Agent, or Firm* — Lamon Patent Services; Cynthia S. Lamon

(57) ABSTRACT

An exercise apparatus, comprising an elongate base platform having a top planar surface, bottom planar surface, a depth, a length and a width. A seat assembly is supported by the base, the seat assembly includes a top planar surface, a bottom surface and wheels attached to the bottom surface. A pliable rolling device is utilized with the apparatus, wherein channels are formed in the depth on the top planar surface of the base platform enabled to accept the wheels and with a first area of a user resting on the seat assembly, a second area of a user resting on the foam roller, the user translates the seat assembly along the channels causing the second area to be translated on the foam roller.

10 Claims, 7 Drawing Sheets

(56) References Cited

U.S. PATENT DOCUMENTS 5,518,483 A * 5/1996 Oswald ..... A63B 21/012 482/114
5,643,162 A * 7/1997 Landers ..... A63B 21/154 482/131
5,702,354 A * 12/1997 DeSpain ..... A63B 23/10 482/132
5,921,901 A * 7/1999 Palacios ..... A63B 22/203 482/132
6,071,217 A * 6/2000 Barnett ..... A63B 21/0552 482/121
6,419,650 B1 * 7/2002 Ryan ..... A61H 15/00 601/122
6,428,497 B1 * 8/2002 Crouch ..... A61F 5/04 128/845
6,607,472 B2 * 8/2003 Toole ..... A63B 21/0552 482/121
6,960,174 B2 * 11/2005 Fenkel ..... A61H 1/0218 601/102
7,311,644 B2 * 12/2007 Hale ..... A63B 21/4015 482/142
7,455,633 B2 * 11/2008 Brown ..... A63B 22/205 482/142
7,744,546 B2 * 6/2010 Lee ..... A61H 1/0237 601/33
7,955,233 B1 * 6/2011 Wu ..... A63B 21/068 482/101
D663,427 S * 7/2012 Sharps ..... D24/184
8,292,837 B2 * 10/2012 Du ..... A63B 23/0417 601/24
9,474,675 B2 * 10/2016 Hansen ..... A61H 1/024
9,526,945 B1 * 12/2016 Edmondson ..... A63B 23/0494
D838,861 S * 1/2019 Smith ..... D24/215
10,220,245 B1 * 3/2019 Halen ..... A63B 22/203
10,765,910 B2 * 9/2020 Salamone ..... A63B 69/0057
10,926,127 B1 * 2/2021 Lagree ..... A63B 21/0428
2002/0151416 A1 * 10/2002 List ..... A63B 21/0552 482/121
2005/0010145 A1 * 1/2005 Fenkell ..... A61H 1/0218 601/99
2005/0079964 A1 * 4/2005 Francavilla ..... A63B 26/003 482/142
2005/0202937 A1 * 9/2005 Cheng ..... A63B 22/0605 482/57
2005/0209074 A1 * 9/2005 Barrows ..... A63B 26/003 482/148
2008/0242519 A1 * 10/2008 Parmater ..... A63B 22/0087 482/72
2012/0108405 A1 * 5/2012 Milo ..... A63B 23/0222 482/142
2013/0184126 A1 * 7/2013 Kole ..... A63B 21/028 482/79
2013/0237393 A1 * 9/2013 Kerdjoudj ..... A63B 22/203 482/122
2014/0171279 A1 * 6/2014 Justice Velasco ..... A63B 26/00 482/142
2014/0296044 A1 * 10/2014 Kucharski ..... A63B 21/00185 482/131
2015/0065320 A1 * 3/2015 Anderson ..... A63B 21/4045 482/142
2015/0246263 A1 * 9/2015 Campanaro ..... A63B 21/068 482/52
2015/0283023 A1 * 10/2015 Phillips ..... A63B 23/03541 601/118
2016/0270998 A1 * 9/2016 Nielsen ..... A61H 1/0266
2017/0043200 A1 * 2/2017 Hall ..... A63B 23/0222
2018/0116902 A1 * 5/2018 Patton ..... A61H 15/00
2019/0262220 A1 * 8/2019 Smith ..... A61H 23/0263
2019/0269573 A1 * 9/2019 Paniccia ..... A61H 1/00
2019/0299052 A1 * 10/2019 St.Cyr ..... A63B 21/00185
2020/0001130 A1 * 1/2020 Schwarz ..... A63B 22/203
2020/0297567 A1 * 9/2020 Lebano, III ..... A61G 13/009

* cited by examiner

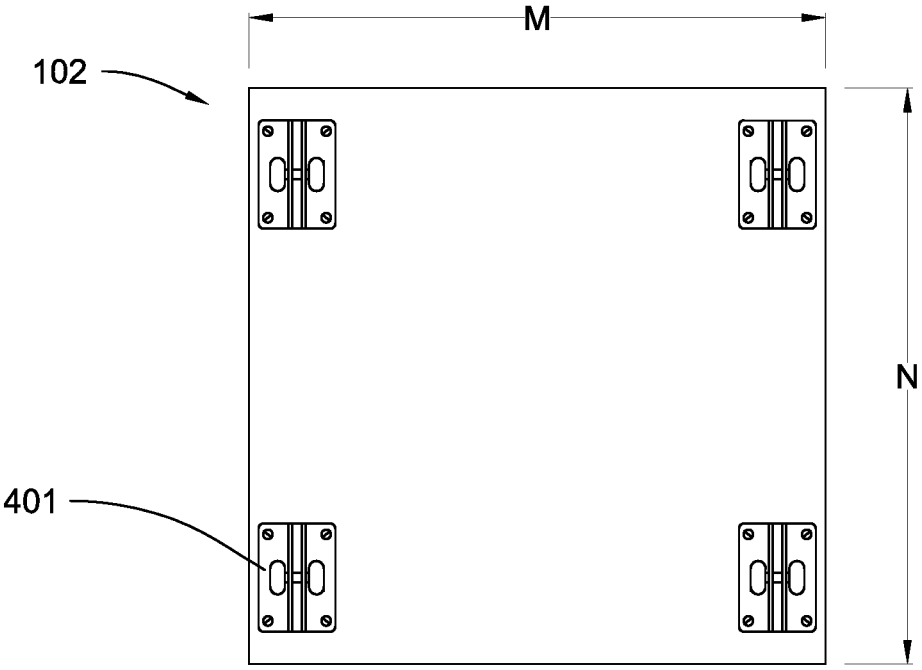
FIG. 6A
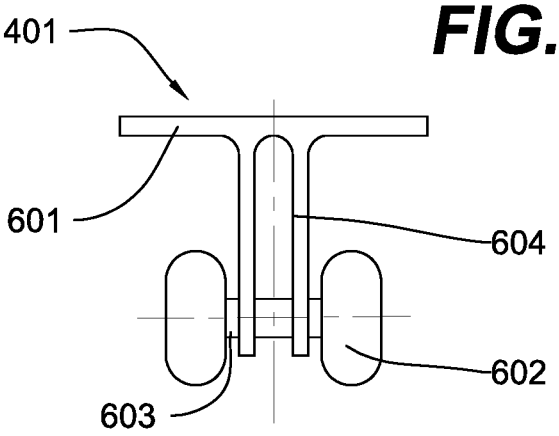
FIG. 6B
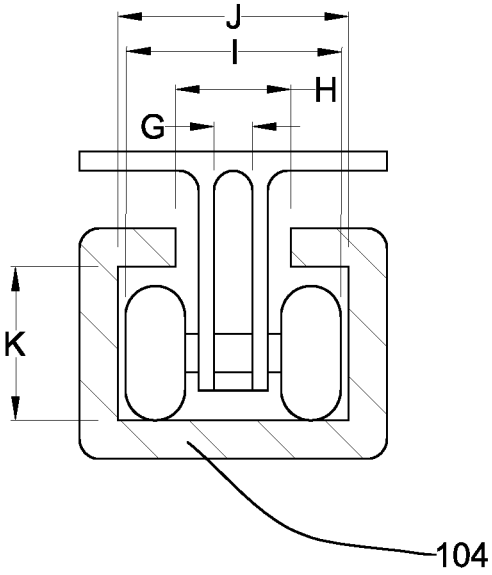
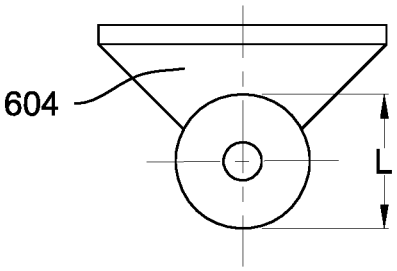
FIG. 6C
FIG. 6D

FOAM GLIDE

CROSS-REFERENCE TO RELATED DOCUMENTS

N/A

BACKGROUND OF THE INVENTION

1. Field of the Invention

The present invention is in the field of physical therapy apparatus as it relates to exercise apparatus, and more particularly, to an auxiliary foam roller exercise support apparatus.

2. Discussion of the State of the Art

Adhesions and scar tissue commonly form as a result of invasive surgeries and injuries. When injured surfaces are close together, the body attempts to heal itself and can cause scar tissue to grow and create a bond between surfaces that were not connected prior to the operation or injury. Additional, general muscle pain may originate from a variety of exercises performed by a user to an extent to cause muscle soreness. Stress may also cause muscle pain and soreness.

Massage has been identified as an effective means to improve blood circulation to relieve muscle, skeletal and other connective tissue discomfort; to increase joint range of motion; and to aid in reducing the development of adhesions as wounds heal. Successful slowing, preventing or non-surgically releasing adhesions through massage may help to avoid a repetitious cycle of surgery, healing and adhesion formation.

Persons trained in massage are certified to perform treatment on patients who have developed or are likely to develop adhesions. Treatment may be performed in a hospital or clinic requiring travel by the patient. It may be performed in the patient's home, but often at an increased cost for those services. It is also possible for a patient to be instructed in methods to "self-massage" in an in-home environment, thereby reducing cost and time commitments and providing scheduling flexibility.

A variety of firm foam rollers have been developed and are marketed for use for self-massage by patients and athletes for physical therapy, pain relief and exercise. In general, the user works on a firm flat surface such as a mat on the floor. In most cases the user places the roller perpendicular to the axis of the body under the area of the body where the muscle soreness or adhesions are. The user arranges his or her body to a position recommended for the specific massage to be performed. Usually such positions require that there are one or two points of contact between the body and the mat, for example an arm and a leg, and a point of contact between the affected body part and the foam roller. This positioning transfers a significant portion of the body weight to rest on the roller, causing a reactive force to be imparted upon the muscle resting on the roller. Properly positioned, the user can then use other body parts in contact with the mat to move the body back and forth in relation to the foam roller in a longitudinal direction. This movement back and forth causes the weight on the roller and the force of the mat below to cause the roll to rotate smoothly up and down the length of the treatment area.

Utilizing the foam roller on its own requires considerable strength and agility to support the body in the recommended positions and to move the body mass in the required directions. Pain or discomfort, or lack of strength can discourage or prevent patients from performing self-massage with a foam roller. The user may be incapable of holding the positions required to effectively perform self-massage.

The Foam Glide assist device is intended to aid a user who may be physically compromised to utilize the foam roller. The device may be used in physical therapy applications, gyms, classes and for individual home use, as well.

SUMMARY OF THE INVENTION

An exercise apparatus is provided in a first embodiment including an elongate base platform having a top planar surface, bottom planar surface, a depth, a length and a width. A seat assembly supported by the base, the seat assembly may include a top planar surface, a bottom surface and wheels attached to the bottom surface. A pliable rolling device is also implemented in the use of the apparatus.

In this embodiment, channels are formed in the depth on the top planar surface of the base platform enabled to accept the wheels and with a first area of a user resting on the seat assembly, a second area of a user resting on the foam roller, the user translates the seat assembly along the channels causing the second area to be translated on the foam roller.

One embodiment provides handrails that may be attached to the base platform outside of the channels enabling a user to engage a third area of the user thereby applying force at the seat assembly causing translation within the channels. In this embodiment, a plurality of braces connect the base platform to the handrails, with the handrails extending linearly away from the base platform.

Another embodiment provides that the base platform is rectangular having a first and second length and a first and second width, and one handrail is attached to and runs along the first length and another handrail is attached to and runs along the second length.

A method for using the exercise apparatus with a foam roller, is also provided. In this embodiment, a user places an area of his or her body weight on a top surface of a platform mounted on wheels and is translatable via channels formed within a depth of a top surface of an elongate planar platform base, the channels enabled to accept the wheels. The user then bears a second area of body weight on a pliable rolling device and the platform is translated via the wheels in the channel, thereby causing the foam roller to translate the second area of body weight.

In one embodiment, the handrails are attached to the base platform outside of the channels enabling a user to engage a third area of the user thereby applying force at the seat assembly causing translation within the channels. Additionally, a plurality of braces connect the base platform to the handrails, with the handrails extending linearly away from the base platform.

One embodiment provides that the base platform is rectangular having a first and second length and first and second ends having a width, and one handrail is attached to and runs along the first length and another handrail is attached to and runs along the second length. In this embodiment, a third area of the user's body is a user's hand, that grasps the handrail, thereby applying force that moves the platform via the wheels in the channels. The ends of the platform may be capped thereby preventing the wheels from leaving the channels at either end.

BRIEF SUMMARY OF THE INVENTION

The present invention assists with self-massage utilizing a foam roller to apply force to generate tension to breakdown surgical adhesions and scar tissue, to improve blood flow to those areas, and to increase mobility. This foam roller assist device is comprised of three main components including the smooth flat base platform, a sliding seat mechanism which supports a portion of the body's weight such that it can easily be moved in a forward and back direction. Handrails enable the user to grip while pulling or pushing to move the body mass on the seat in relation to the platform and the foam roller.

BRIEF DESCRIPTION OF THE SEVERAL VIEWS OF THE DRAWINGS

FIG. 6A is a bottom view of sliding seat.

FIG. 6B is an end view of wheel assembly.

FIG. 6C is a side view of wheel assembly.

FIG. 6D is a cross section view of wheels in track.

DETAILED DESCRIPTION OF THE INVENTION

Figure 1:
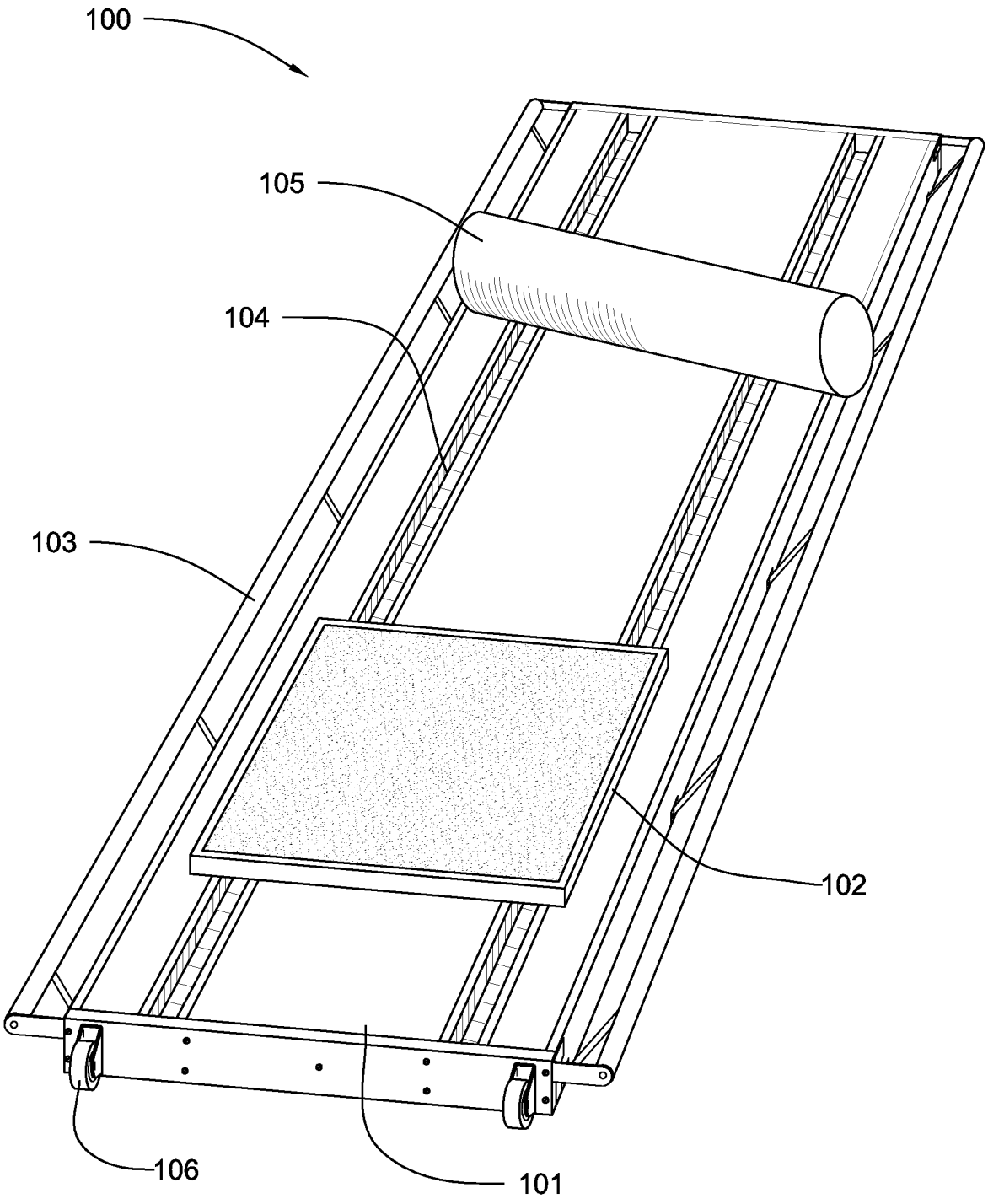
FIG. 1 is a perspective view of the device and a foam roller.

FIG. 1 provides a preferred embodiment of assist device 100 to enable physically compromised or less able persons to use in conjunction with a foam roller 105 to perform self-massage in a clinic setting, in a classroom, at home or while traveling. Device 100 is comprised of a sturdy base platform 101, an affixed sliding seat assembly 102, and attached handrails 103 along each side of platform 101. Seat 102 travels the length of the platform in integrated tracks 104. Foam roller 105 may be one of many types of commercially available styles including cylinders, tubes, spheres, etc. and may be of varying diameter, materials, firmness and texture. Device 100 may be equipped with wheels 106 on one end allowing the user to lift the device by handrails 103 at the opposite end and wheel the device to a new location of use or to storage.

Figure 2:
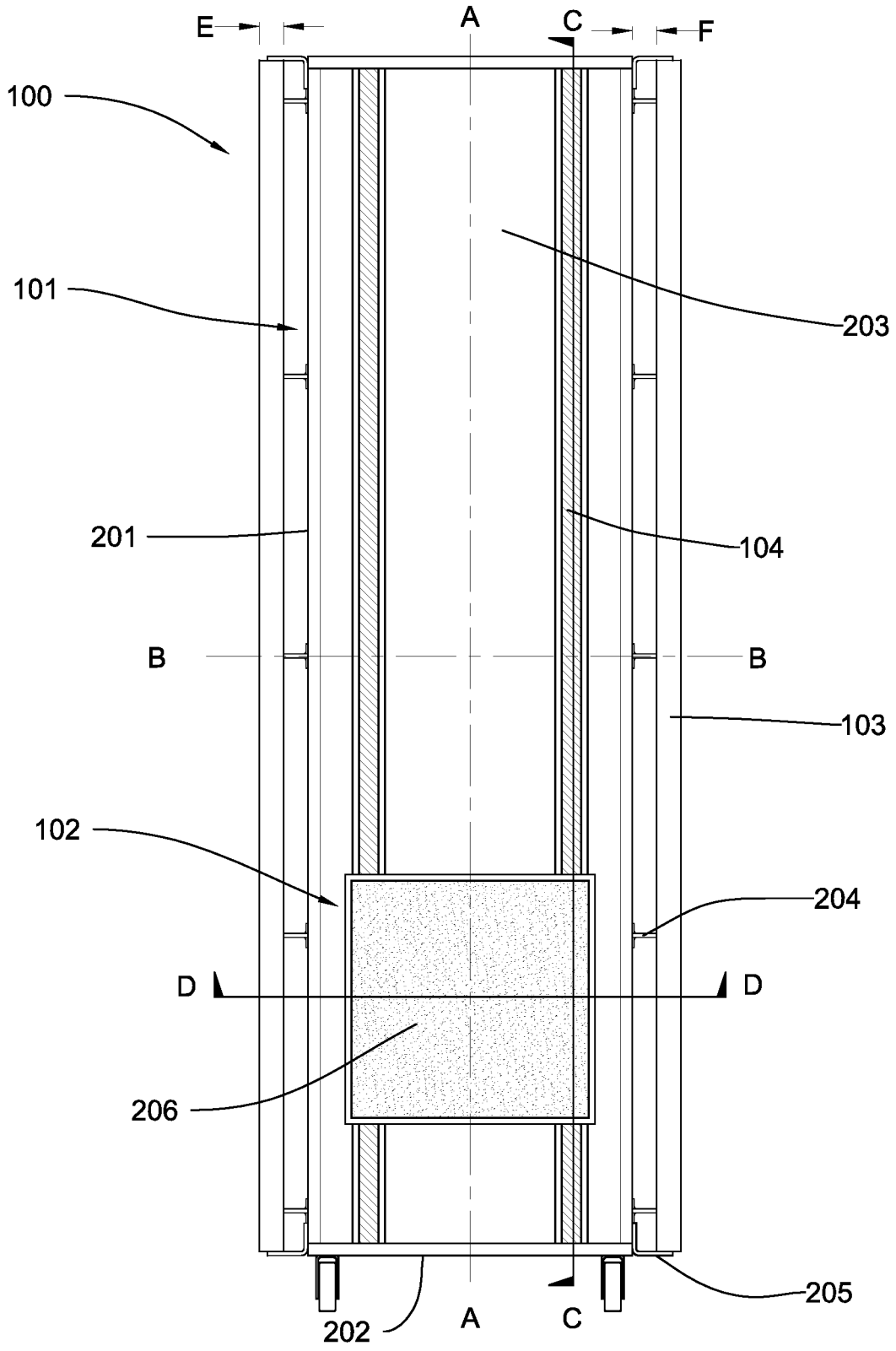
FIG. 2 is a plan view of the device.

FIG. 2 provides a plan view of device 100. Platform 101 is symmetrical along its lengthwise centerline axis A-A and crosswise centerline B-B. Section lines C and D are described in a later figure. Device 100 can be used with the head at either end. Platform 101 has side frame pieces 201 on each side and end frame pieces 202 at each end. It has a firm flat platform surface 203 extending from side frame 201 to the opposite side frame and from end frame 202 to the opposite end frame. Tracks 104 are installed such that they are flush with surface 203. Handrails 103 are affixed to side frames 201 with diagonal handrail support brackets 204 equally spaced along each side and with end support angles 205 at each end. In addition to adding support, they prevent exposed ends of handrail 103 that can cause a tripping hazard or can hook loose clothing. Handrails have a Diameter E in the range of 1¼ inch minimum to 2 inch maximum, as is typical of handrails for staircases. Handrails may be tubular to fit a user's hand and installed as to extend linearly from the side frames. They are installed a minimum Distance F of 1½ inch from side frame 201 to provide clearance for a safe ergonomic grip.

Platform 101, seat 102 and handrails 103 in this embodiment are illustrated in wood. Other embodiments of the device could make use of materials such as fiberglass or durable plastics. All surfaces of device 100 shall be manufactured with a smooth finish to enhance their function. The top surface 206 of seat 102 shall be treated with a non-skid material to provide friction to effectively transfer force from the body to move the seat in the desired direction.

Figure 3:
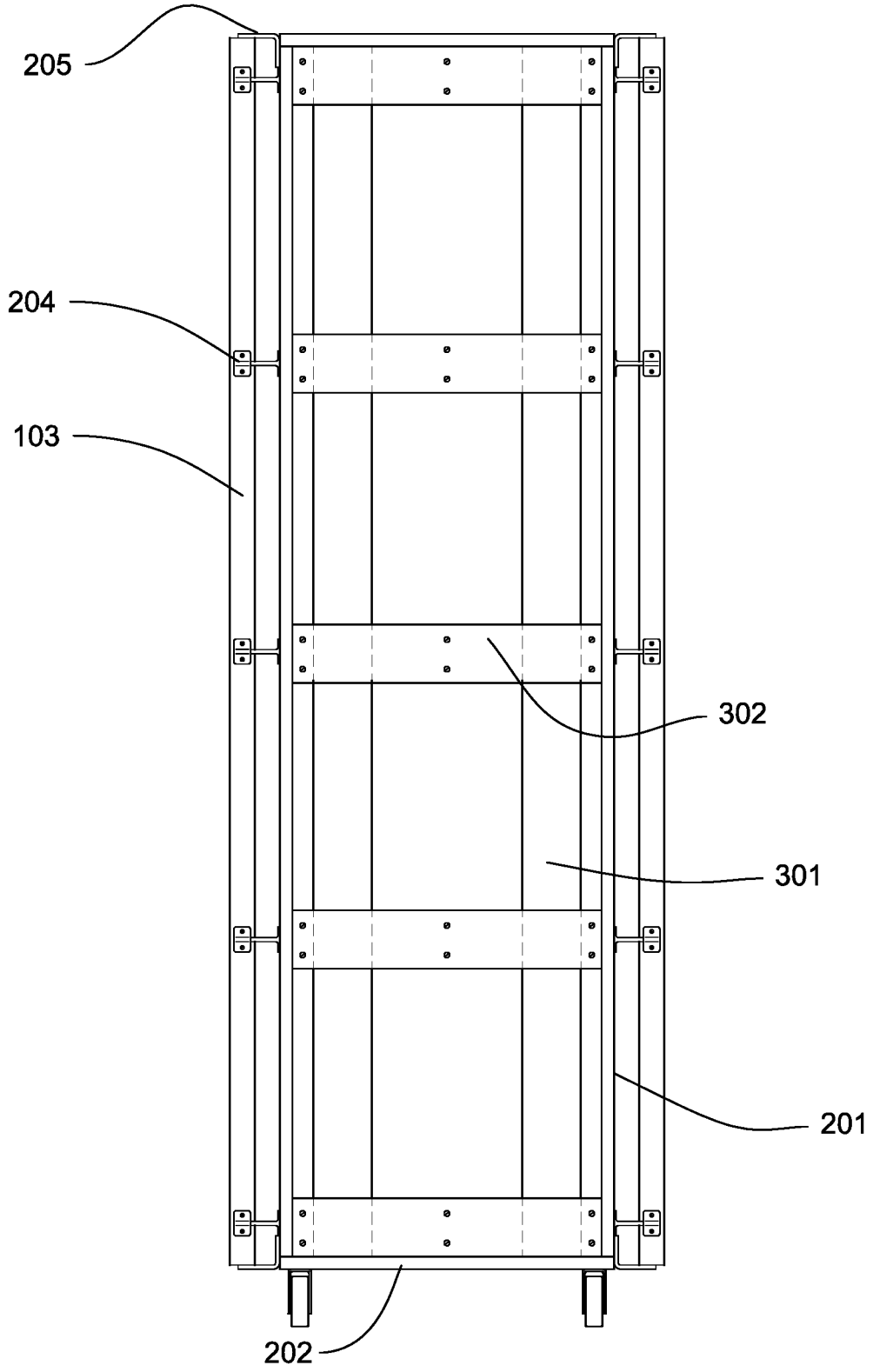
FIG. 3 is a bottom view of the device.

FIG. 3 provides a view of the underside of platform 101 and handrails 103. Supports 204 can more clearly be seen to attached to the underside of handrail 103 to avoid interference with grip on the handrail. This figure also shows the lengthwise support members 301 and the crosswise support members 302. These members provide support to integral tracks 104 as well as tying together side frame members 201, end frame members 202 and surface 203 into a firm rigid platform to support the user's weight and dynamic forces of movement.

Figure 4A:
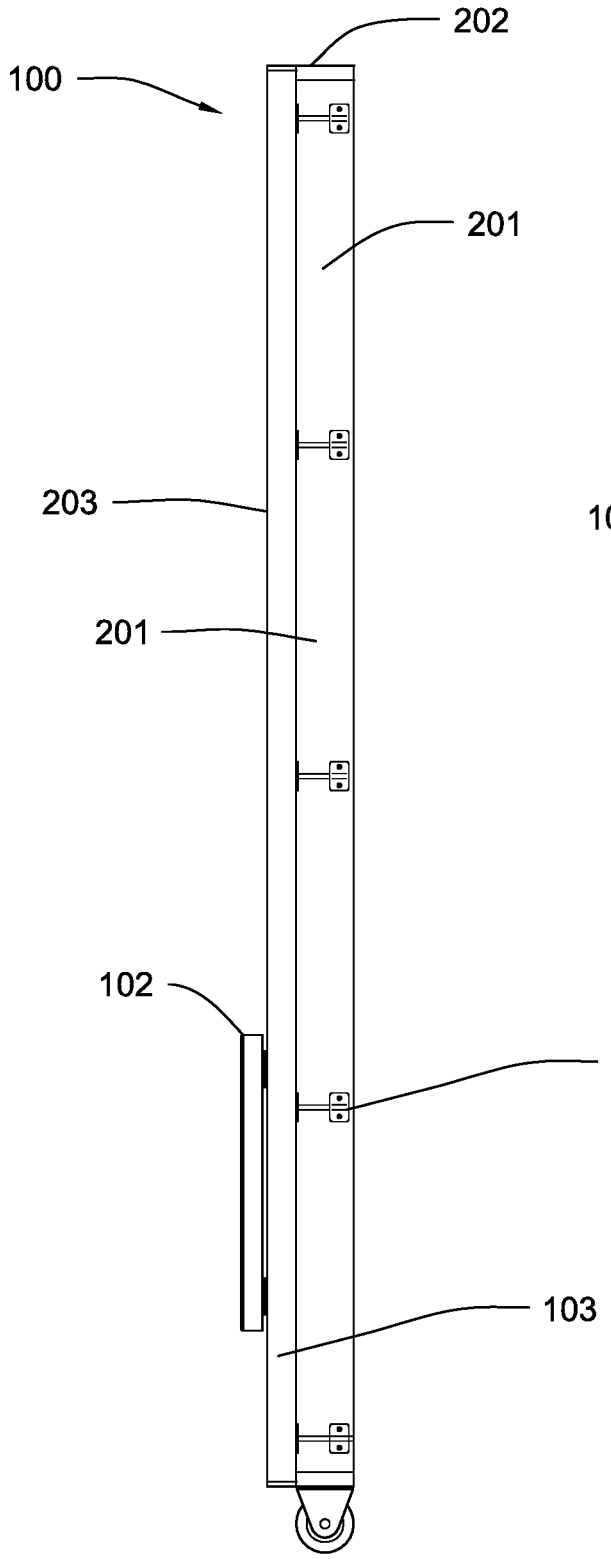
FIG. 4A is a side elevation view of the device.
Figure 4B:
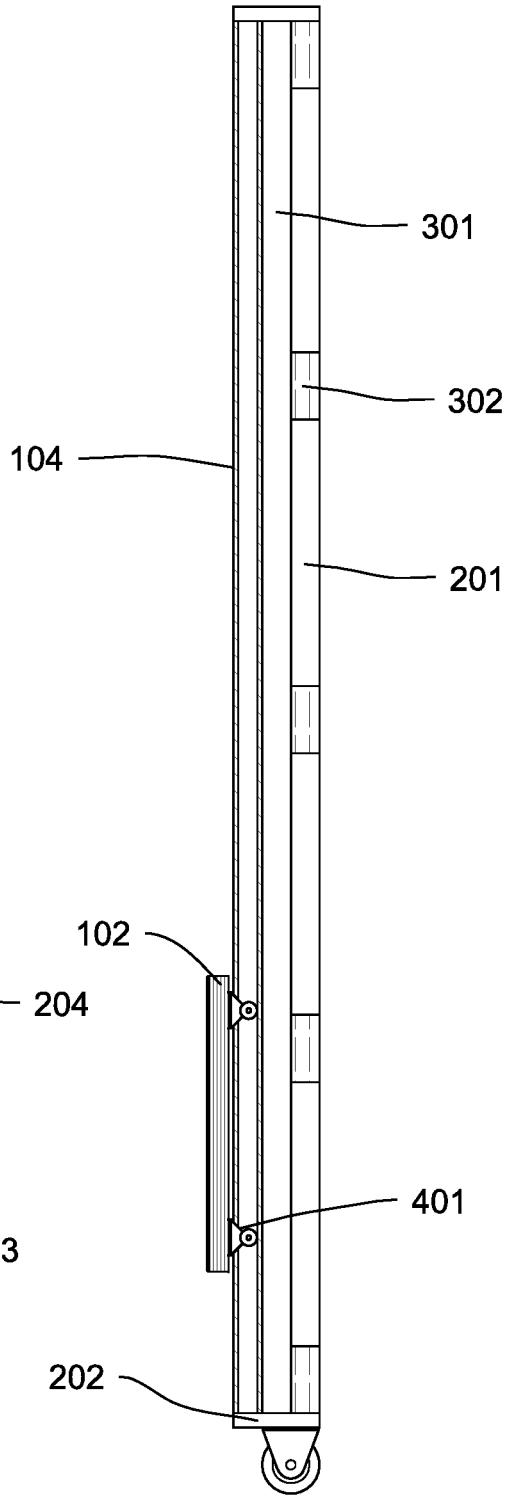
FIG. 4B is a lengthwise cut view of the device.

FIG. 4A shows a side view of device 100. Handrails 103 can be seen supported by brackets 204. FIG. 4B shows a lengthwise cut view of device 100 along Section C-C indicated on FIG. 2 along the center of track 104. The top surface of track 104 is flush with the top of surface 203 and the tops of side frame 201 called out in FIG. 4A to the left. Wheel assemblies 401 roll in recessed tracks 104. Lengthwise supports 301 and crosswise supports 302 can be seen in this section view.

Figure 5A:
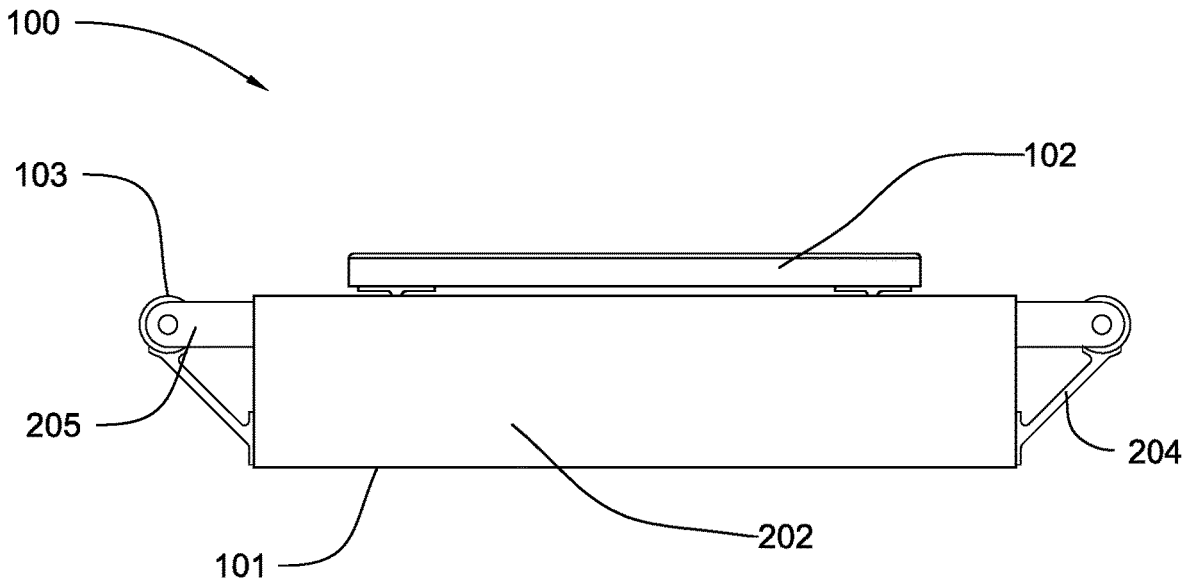
FIG. 5A is an end view of the device.
Figure 5B:
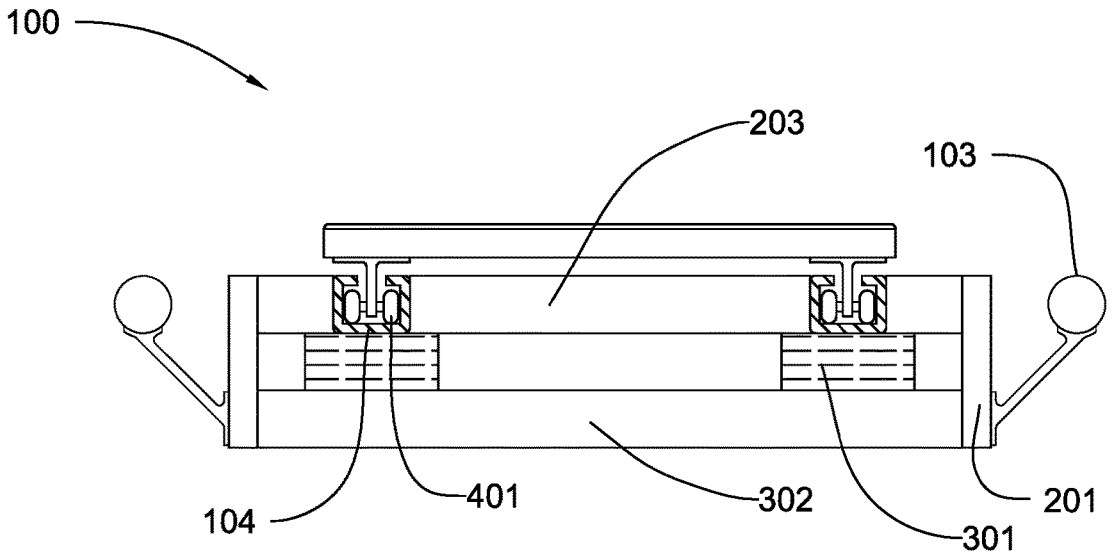
FIG. 5B is crosswise cut view of the device.

FIG. 5A shows an end view of device 100. Handrail end brackets 205 can be seen on each side. FIG. 5B shows a section view taken along Section D-D in FIG. 2. This view shows how side-by-side wheel assemblies 401 fit encompassed within tracks 104. End frames 202 create closures to tracks 104 such that the wheeled seat stays with platform 101.

FIG. 6A provides a bottom view of seat 102. Wheeled assemblies 401 are affixed to the bottom of seat 102. FIG. 6B provides a front and FIG. 6C provides a side view of an example of side-by-side wheel assembly 401 that will work in this configuration. The flanges are screwed to the bottom of seat 102. Durable metal, rubber or plastic wheels 602 are mounted on axle 603 through a double bracket web 604. Width M of seat 102 in this example is approximately 14½ inches. Seat 102 should be slightly narrower than base platform 101 so that there is no interference with the user's hand or arm while gripping handrail 103. Seat 102 Length N in this example is 14½ inches but could be slightly shorter or longer in other embodiments of this device. The corners of seat 102 are depicted as square but may be radiused in other embodiments.

FIGS. 6C and 6D (cross-section) shows that thickness Dimension G of web 604 of bracket 601 is narrower than the width Dimension H of the opening of track 104. The combined width Dimension I of wheels 602 is greater than Dimension H keeping wheels 602 secured inside track 104. Dimension I is narrower than inside width Dimension J of track 104 and diameter Dimension L of wheel 602 is smaller than the inside height Dimension J of the track to allow the wheels to roll easily inside.

Figure 7A:
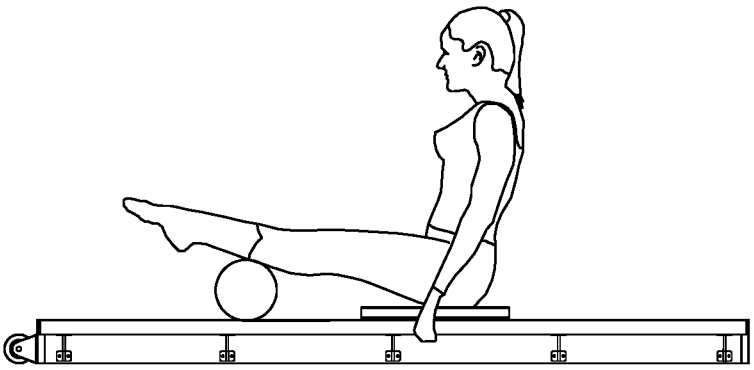
FIG. 7A provides an example view of treating back of legs.

FIG. 7A shows a user in the proper position to self-massage the back of the legs. The user sits upright on seat 102 in the center of platform 101 with legs extended straight out toward one of the ends 202 with roller 105 placed beneath the legs. The user grips handrails 103 on each side of the device and slowly pulls and pushes so that roller 105 massages the underside of the legs. This massage can be used from the Achilles tendon to the upper hamstring area of the quad.

Figure 7B:
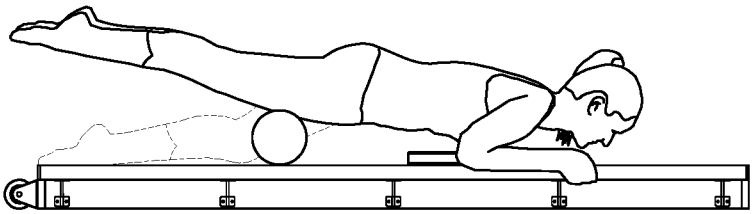
FIG. 7B provides an example view of treating front of legs.

FIG. 7B demonstrates a user in position to self-massage the front of the quads. The user lies with chest on seat 102 near the center of platform 101 with toes pointed toward end frame 202 and places roller 105 under one or both quads. Gripping handrails 103 on each side of the platform, the user can pull or push to move the platform forward and back longitudinally along platform 101, thus massaging from the hips down to the knees. The user may pause when roller 105 is under a tight or painful area to work out tension. The user may place roller 105 on an underside of one or both thighs based on preference. The other leg may rest on the smooth surface of platform 101 as suggested by the dashed outline in this figure.

Figure 7C:
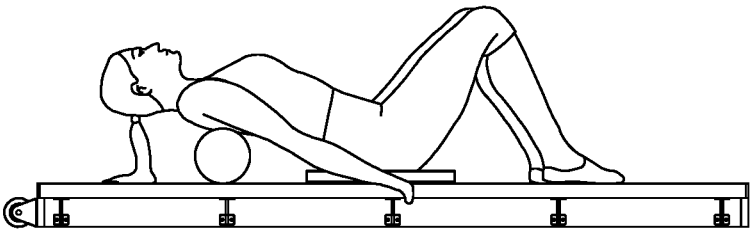
FIG. 7C provides an example view of treating upper back.

FIG. 7C depicts a user in position to self-massage the upper area of the back. In this figure, the user is seated on seat 102 positioned near the center of platform 101 reclining back onto foam roller 105. The user's feet may be placed on the platform to exert force to move seat 102 forward and back such that the area of the back to be treated moves over roller 105. The user may choose to utilize handrails 103 or not subject to preference. In this example, all of the user's body weight, or a majority of the user's bodyweight is distributed and supported between the seat 102 and roller 105. In some embodiments, no part of a user's body rests upon platform 101 and all of the bodyweight is distributed between the roller 105 and seat 102.

As another example, not illustrated here, the user may self-massage the outer thigh or IT bands. The user lies on her side placing the left arm on seat 102 and placing roller 105 under the left thigh. The user supports her weight on the left arm and foam roller 105, with the back straight and toes parallel and pointed toward end 202. In this example, the user will lower her right arm and grasp handrail 103 with her right hand. Exerting force on handrail 103 toward the hips will cause seat 102 and the user's body to move in the direction of the head. Exerting force on handrail 103 toward the shoulders and head will move seat 102 and the user's body to move in the other direction. These movements will cause roller 105 to massage the thigh as the body moves forward and back over the roller.

These demonstrations are several of many various positions that may be implemented with device 100 to self-massage other body parts with one or more styles of foam rollers. The skilled person will understand that all of the embodiments and variations described above are entirely exemplary, and not limiting. There may be many different implementations of apparatus in different embodiments and many different interactive interfaces in remote control apparatus, including smart phones or tablets, for a variety of purposes. Different apparatus may have different numbers of arms, and lengths of arms, among other differences within the scope of the invention. The invention is limited only by the claims that follow.

The invention claimed is:

1. An exercise apparatus, comprising:

an elongate base platform having a top planar surface, bottom planar surface, a depth, a length and a width;

a seat assembly supported by the base platform, the seat assembly including a top planar surface, a bottom surface and wheels attached to the bottom surface;

a pliable rolling device and wherein channels are formed in the depth on the top planar surface of the base platform enabled to accept the wheels and enabling a first area of body weight of a user to rest on the seat assembly, a second area of body weight of the user enabled to rest on the pliable rolling device, the user is enabled to translate the seat assembly along the channels causing the second area to be translated on the pliable rolling device.

2. The apparatus of claim 1, wherein handrails are attached to the base platform outside of the channels enabling the user to engage a third area of body weight enabling the user to apply force at the seat assembly causing translation within the channels.

3. The apparatus of claim 2, wherein a plurality of braces connect the base platform to the handrails, with the handrails extending linearly away from the base platform.

4. The apparatus of claim 3, wherein the base platform is rectangular having a first and second length and a first and second width, and one handrail is attached to and runs along the first length and another handrail is attached to and runs along the second length.

5. A method for using an exercise apparatus with a pliable rolling device, comprising the steps of:

(a) bearing a first area of body weight of a user on a top surface of a platform mounted on wheels and translatable via channels formed within a depth of a top surface of an elongate planar platform base, the channels enabled to accept the wheels;

(b) bearing a second area of body weight of a user on a pliable rolling device; and (c) translating the platform via the wheels in the channel, thereby causing the pliable rolling device to translate the second area of body weight.

6. The method of claim 5, wherein handrails are attached to the base platform outside of the channels enabling a user to engage a third area of the user thereby applying force at the seat assembly causing translation within the channels.

7. The method of claim 6, wherein a plurality of braces connect the base platform to the handrails, with the handrails extending linearly away from the base platform, thereby enabling the translation of step (c).

8. The method of claim 7, wherein the base platform is rectangular having a first and second length and first and second ends having a width, and one handrail is attached to and runs along the first length and another handrail is attached to and runs along the second length, enabling the user to grasp the handrails to aid in the translation.

9. The method of claim 6, wherein the third area of body weight is enabled to engage any one of the user's arm or hand to the handrail, thereby applying force that moves the platform via the wheels in the channels.

10. The method of claim 8, wherein the ends are capped thereby preventing the wheels from leaving the channels at either end and therefore limiting the translation.

* * * * *